US011155103B2

(12) United States Patent
Yraceburu et al.

(10) Patent No.: US 11,155,103 B2
(45) Date of Patent: Oct. 26, 2021

(54) DRYER SYSTEM TO COOL PRINTER

(71) Applicant: Hewlett-Packard Development Company, L.P., Spring, TX (US)

(72) Inventors: Robert Yraceburu, Vancouver, WA (US); William Winters, Sumner, WA (US); Timothy Jacob Luedeman, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/332,083

(22) PCT Filed: Sep. 12, 2016

(86) PCT No.: PCT/US2016/051262

§ 371 (c)(1),
(2) Date: Mar. 11, 2019

(87) PCT Pub. No.: WO2018/048437

PCT Pub. Date: Mar. 15, 2018

(65) Prior Publication Data

US 2019/0202217 A1 Jul. 4, 2019

(51) Int. Cl.

| | |
|---|---|
| ***B41J 11/00*** | (2006.01) |
| ***B41F 23/04*** | (2006.01) |
| ***B41L 23/20*** | (2006.01) |
| ***B41J 29/377*** | (2006.01) |

(52) U.S. Cl.

CPC ..... *B41J 11/002* (2013.01); *B41F 23/04* (2013.01); *B41F 23/0466* (2013.01); *B41J 29/377* (2013.01); *B41L 23/20* (2013.01)

(58) Field of Classification Search

CPC ..... B41F 23/04; B41F 23/0466; B41J 11/002; B41J 29/377; B41L 23/20

See application file for complete search history.

(56) References Cited

U.S. PATENT DOCUMENTS

| | | | |
|---|---|---|---|
| 6,340,225 | B1 | 1/2002 | Szlucha |
| 6,854,842 | B2 | 2/2005 | Martin et al. |
| 6,863,393 | B2 | 3/2005 | Patterson |
| 6,966,653 | B2 | 11/2005 | Kitabayashi |
| 7,052,124 | B2 | 5/2006 | Pickup |
| 8,848,208 | B2 | 9/2014 | Sumioka |
| 9,248,666 | B2 | 2/2016 | Fuchioka et al. |
| 2003/0011986 | A1 | 1/2003 | Ariga |
| 2003/0160852 | A1 | 8/2003 | Pickup |
| 2009/0031579 | A1 | 2/2009 | Piatt et al. |
| 2010/0188455 | A1 | 7/2010 | Osamu et al. |
| 2016/0023476 | A1 | 1/2016 | Leighton et al. |

FOREIGN PATENT DOCUMENTS

| | | |
|---|---|---|
| CN | 1109004 | 9/1995 |
| CN | 1853927 | 11/2006 |
| WO | WO-2015151772 | 10/2015 |

*Primary Examiner* — Jannelle M Lebron

(74) *Attorney, Agent, or Firm* — HP Inc. Patent Department

(57) ABSTRACT

A printer including a print bar and a dryer system. The print bar operates to deposit printing material in accordance with a print job. The dryer system operates to intake and heat air from an internal region in which one or more electrical components of the printer are located. The dryer system directs the heated air through multiple outlets that are acutely angled with respect to a location or media of deposited printing material, to dry the printing material while cooling the internal region of the printer.

15 Claims, 4 Drawing Sheets

DRYER SYSTEM TO COOL PRINTER

BACKGROUND

Some printers use dryers to dry ink material on print media. For example, ink jet printers move print media (e.g., paper) alongside a surface of the dryer to dry ink that has been deposited by the printer as a result of a print job. Such printers can use dedicated cooling components, such as fans, to prevent the printer from overheating. Such components are an added cost and complexity.

DETAILED DESCRIPTION

Examples as described provide a printer that uses a dryer to cool an interior of the printer. In such examples, the dryer can have an alternative role of cooling the interior of the printer, when the dryer is operated to dry printing material (e.g., ink) on media. Among other benefits, an example printer as described lessens or eliminates use of alternative mechanisms, such as a standalone fan, to cool an interior of the printer.

In some examples, a printer includes a dryer (or dryer system) to induce an airflow in which heated air is directed from the dryer along the media path and is directed outside of the printer at a location that coincides with the ejection of the print media.

Still further, in some examples, an interior of the printer can be thermally isolated to promote circulation and operation of the dryer.

Among other benefits, an example printer as described is able to configure a dryer (or dryer system) to cool an interior of the printer without use of a dedicated cooling mechanism (e.g., fan). In this way, the dryer can efficiently dry print media while preventing printer components from overheating.

Additionally, an example printer as described can operate by recirculating heated air that is used for drying. Some of the heated air is expelled from the printer to maintain relatively low humidity levels in the dryer. This allows the printer to operate the dryer at lower temperatures without a significant increase in the amount of power used by the printer. In this way, the printer can efficiently use a dryer to heat printing material (e.g., ink) on print media, while at the same time cooling an interior of the printer.

Figure 1:
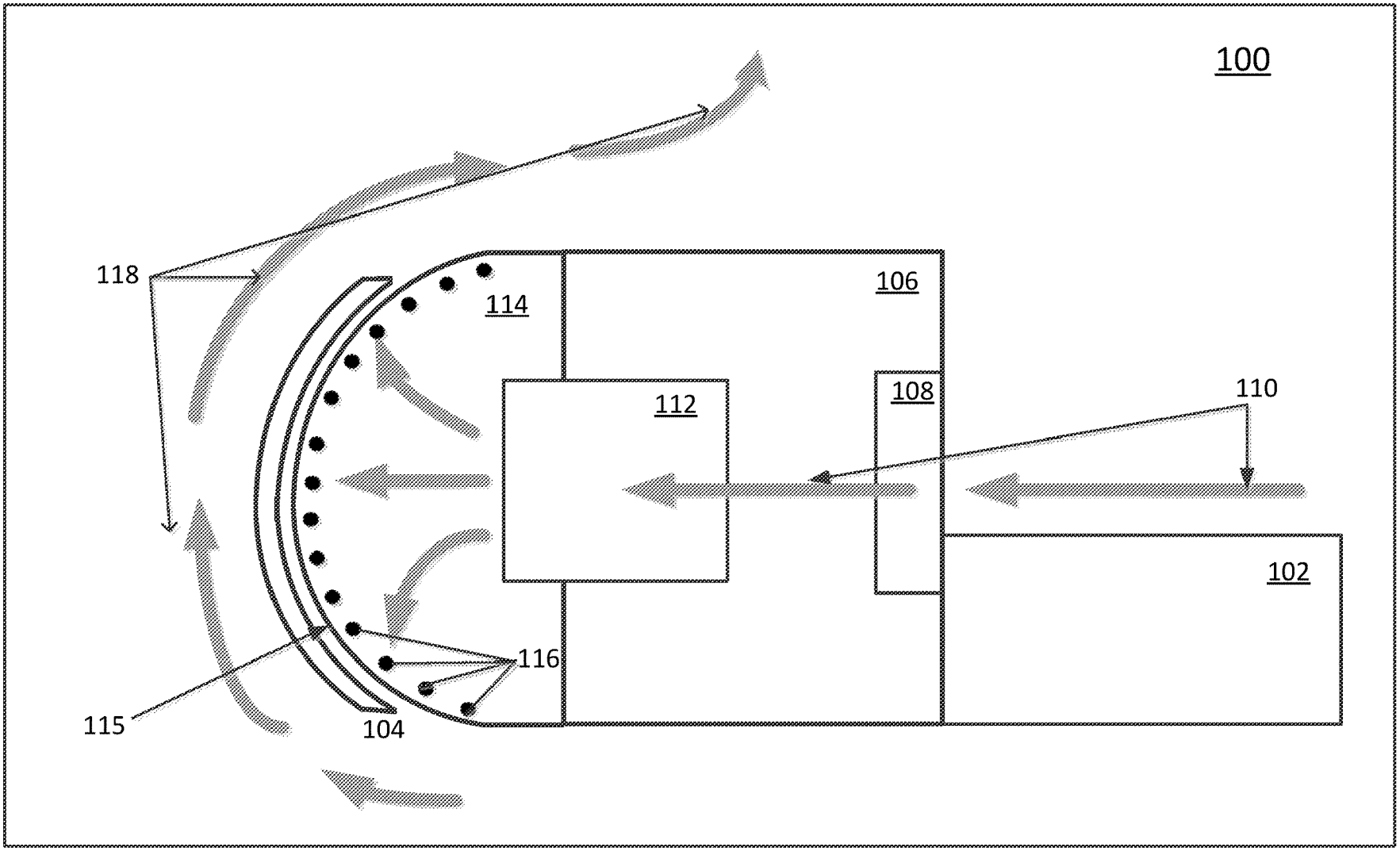
FIG. 1 illustrates an example printer.

FIG. 1 illustrates an example printer. A printer 100 may correspond to, for example, an ink jet printer which deposits liquid ink on print media (e.g., paper, plastic). In such examples, a dryer 114 is used to dry the ink on the print media prior to the print media being ejected. While some examples are described in context of a printer that deposits ink on print media (e.g., ink jet printer), variations may extend to other types of printers, including 3-D printers.

With further reference to FIG. 1, printer 100 includes a print bar assembly 102 and dryer 114. In some examples, the print bar assembly 102 includes an interface to deposit ink onto a print media (e.g., paper, plastic sheet, etc.) in accordance with a print job. The print job may correspond to, for example, an operation which is to result in the print media carrying an ink pattern that corresponds to a document or image. As described with some examples, the dryer 114 may generate an airflow that promotes the print media along a media path while drying the deposited ink on the print media. In generating the air flow, examples provide that the dryer 114 cools an interior region of the printer 100.

In variations, the printer 100 may include an alternative media interface (e.g., nozzle(s)) to deposit filament that is heated into liquid (e.g., as droplets or layers) or malleable form. The filament may be deposited onto a location that layers and/or solidifies into a three-dimensional structure specified with a print job. In some examples, the dryer 114 can apply a heating medium (e.g., air) to the filament in order to solidify the structure of the print job. In applying the heating medium, the dryer may intake air from the interior of the printer to cause a cooling effect.

The printer 100 may operate by guiding a print media 104 past an interface of the print bar 102, where an ink deposit is made on a surface of the print media. The surface of the print media is guided past the dryer 114, so that the expelled heat from the dryer dries the ink on the print media. In some examples, the dryer 114 may be thermally isolated from a remainder of the printer's interior. For example, the dryer 114 may be located within a dryer zone 106 that is thermally isolated with thermally insulative baffles or structures. Among other benefits, the dryer 114 is thermally isolated to mitigate or preclude a heating effect on electrical components within the interior of the printer 100.

The dryer 114 may include an intake 108 to draw incoming air 110. The dryer 114 may include a heating element 112 that similarly heats the incoming air 110 for distribution onto the print media 104.

In some aspects, the dryer 114 includes a number of outlets 116 that directionally eject heated air onto a surface of print media 104. The outlets 116 are oriented to expel heated air in a direction that is acutely angled and in line with a path of travel of the media 104 past a surface 115 of the dryer 114. The resulting airflow may be expelled from the printer 100 at a designated location, such as the location where the print media is output. In this way, the dryer 114 performs the functions of drying ink deposited on the media surface, while directing heated airflow 118 in a manner that cools the interior of the printer.

As a result, the dryer 114 may be a part of an entire dryer system that induces an airflow of heated air within the printer 100. This airflow can be directed in an area away from printer components that need to be cooled. The airflow can, in some examples, extend between the dryer zone 106 and an outlet to the outside of the printer 100. The airflow may also extend from around the surface 115 of the dryer 114 to the outlet that ejects air outside the printer 100.

A dryer impeller fan can create a negative pressure with respect to the outside pressure. This induces outside air to be drawn into the printer 100 toward the dryer 114 and/or dryer zone 106. The difference in pressure can also induce air already within the printer 100 to be drawn toward the dryer 114 and/or dryer zone 106. The incoming airflow 110 toward the dryer 114 and/or dryer zone 106, accordingly, can be made up of both outside and inside air, and as it travels over printer components, those printer components are cooled by the incoming airflow 110 temperature. Since printer components heat up while in use, ambient room temperature may be sufficient to assure the printer components do not overheat.

Additionally, the dryer 114 and/or dryer zone 106 may be thermally isolated within the printer 100. Thermal isolation prevents heat from entering the areas of the printer with printer components. In some examples, a frame within the printer 100 may include structural elements that physically and thermally isolate a region in which electrical components of the printer are retained. Thermal isolation can be accomplished with a structure made up of an air dam, a plastic rib, a baffle, foam, gaskets, and/or a combination or layers of these.

Figure 2:
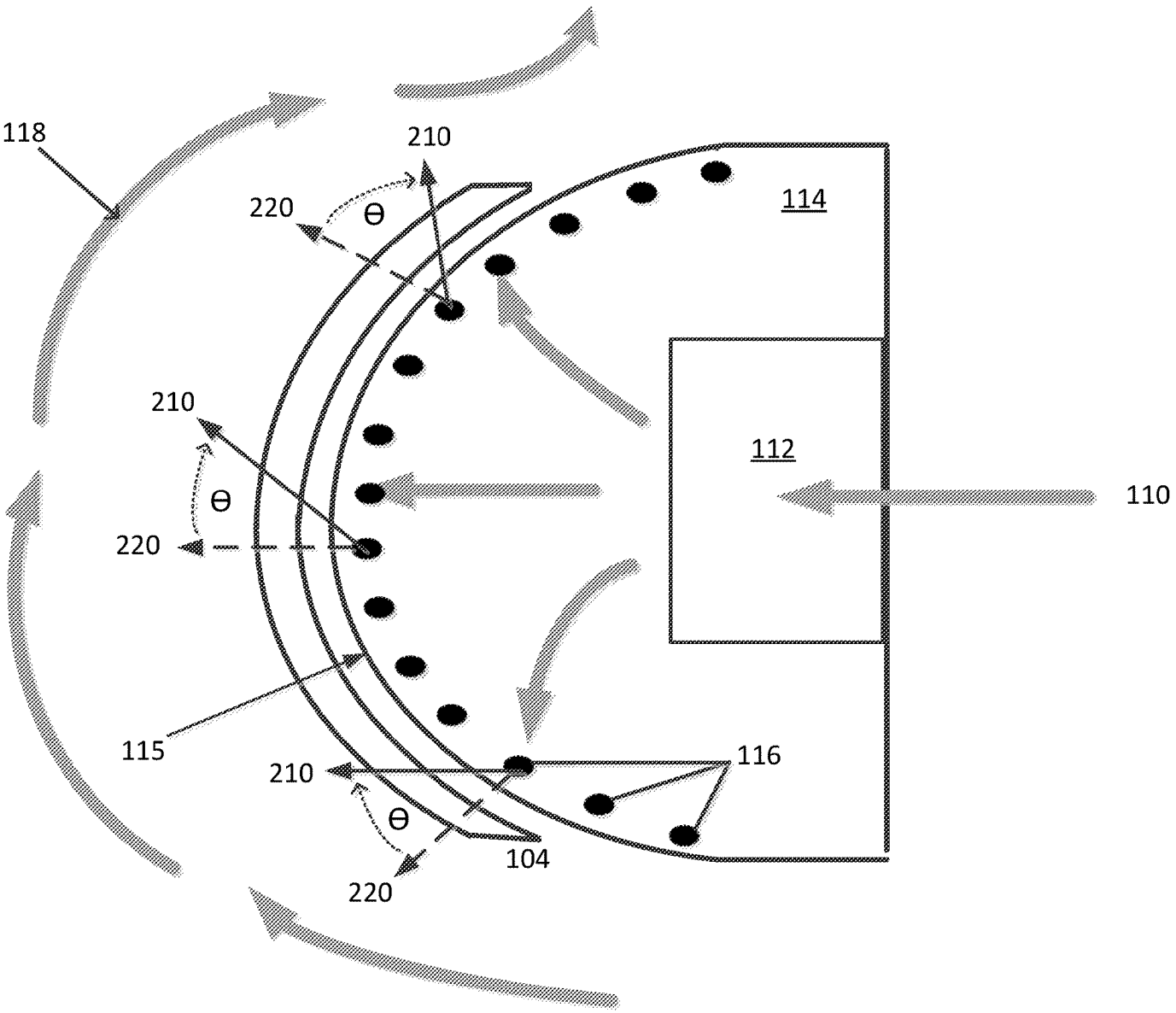
FIG. 2 illustrates an example dryer for a printer, such as described with an example of FIG. 1.

FIG. 2 illustrates an example dryer for a printer, such as described with an example of FIG. 1. As described with reference to FIG. 1 above, the dryer 114 can include a heater element 112 that heats air in a thermally isolated zone. The dryer 114 may further include a number of outlets 116 that are acutely angled with respect to the media 104 such that the outlets 116 directionally induce airflow 118 of heated air. The airflow of heated air 118 may extend from the thermally isolated zone through the heating element 112 in some particular direction. The heated air flow 118 may, in some examples, ultimately be expelled into a surrounding region.

In some aspects, the multiple outlets 116 can output or eject, at each outlet, a corresponding portion of the heated air. The heated air can be output in an ejected air direction 210 that is acutely angled with respect to the media 104 surface. In some examples, the outlets 116 can be nozzles that are angled in such a way as to induce the ejected air into moving en masse in a particular direction, such as the heated airflow 118 path shown in FIGS. 1 and 2. In order to generate a momentum of air directed along a heated airflow path 118 towards an outlet (e.g., a media eject slot), the nozzles may be directed at an angle θ relative to a normal 220 of the media 104 surface. As used herein, a "normal" to a surface refers to a direction or vector that is perpendicular to the surface of the media 104. Some examples, for instance, can include outlets 116 with angles θ varying between 10 and 40 degrees with respect to the normal 220 of the media 104 surface. In addition, some example dryers can have outlets 116 with varying angles θ, while other example dryers 116 can include outlets 116 with the same angle θ. However, some example dryers can include all or a portion of outlets 116 with angles θ less than 0 degrees with respect to the normal.

Figure 4:
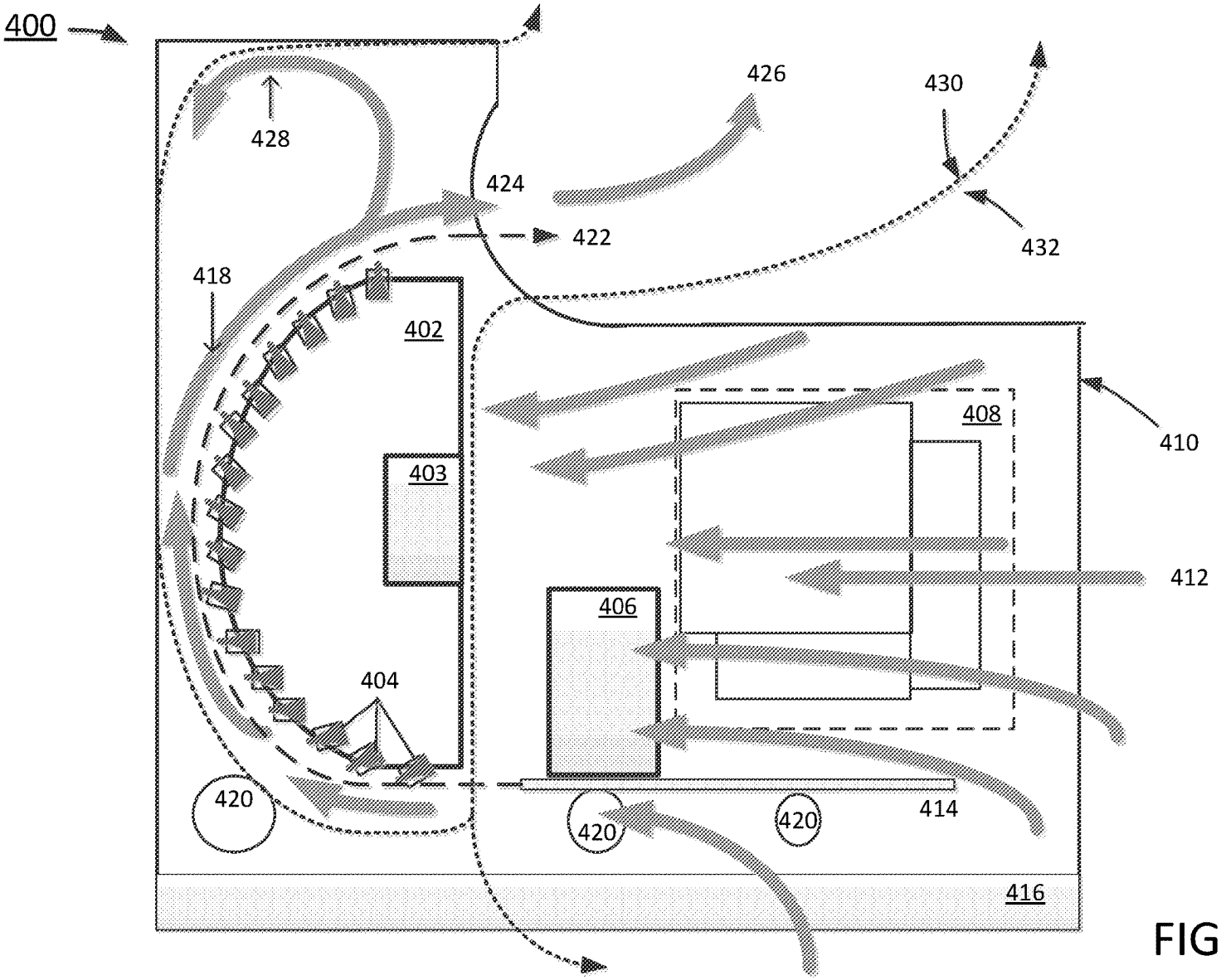
FIG. 4 illustrates another example printer.

In other examples, the outlets 116 or nozzles may be coupled to a heating element and an impeller fan (as shown in FIG. 4). The impeller fan may bring incoming air 110 into the dryer 114 and then mix and pressurize the incoming air 110 before ejecting it through each outlet 116.

Figure 3:
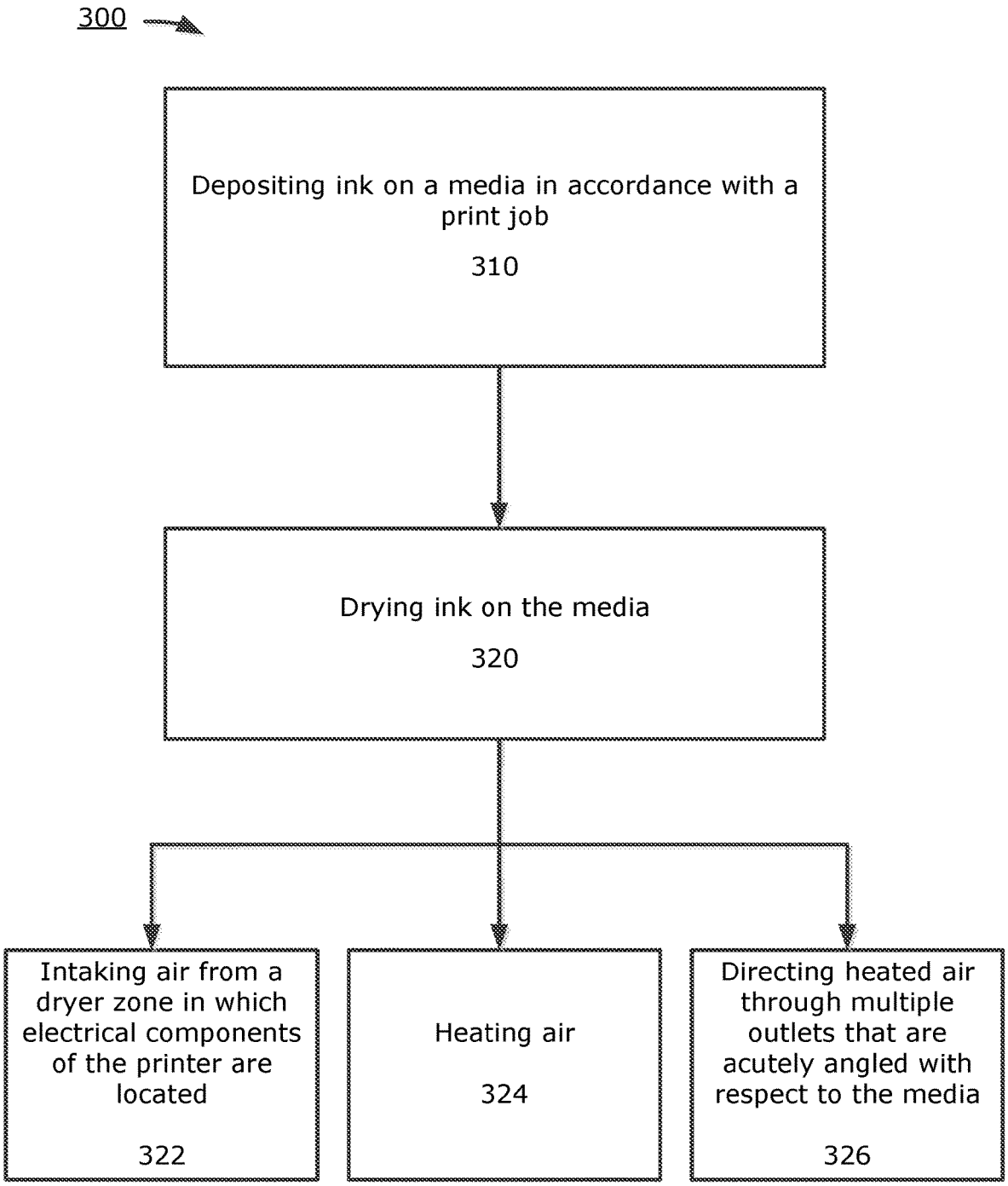
FIG. 3 illustrates an example method for operating a printer to dry ink on media while cooling an interior of the printer.

FIG. 3 illustrates an example method for operating a printer to dry ink on media while cooling an interior of the printer. A method such as described with an example of FIG. 3 may be implemented using a printer or dryer such as described with other examples. Accordingly, reference may be made to elements of FIG. 1 or FIG. 2 for purpose of illustrating a suitable component for performing a step or sub-step being described.

With reference to an example of FIG. 3, a printer 100 operates to deposit ink on the print media 104 in accordance with a print job (310). For example, the printer 100 may deposit ink with a print bar assembly 102.

The printer 100 may further dry ink on the media (320). For example, the printer 100 can intake air from a portion of the printer 100 in which one or more electrical components of the printer are located (322). The printer 100 may heat (324) the intake air and then direct (326) that heated air through multiple outlets 116 that are acutely angled with respect to the media 104 in order to dry the ink.

In some variations, the printer 100 implements a method such as described with FIG. 3 in context of recirculating the heated airflow 118. For example, the printer 100 can dry a media 104 in a subsequent print operation. For example, the printer 100 may operate to dry another media 104 when performing another print operation using recycled air from the heated airflow 118. In some examples, recirculation can be accomplished using a recycling conduit or recirculation duct that recirculates a portion of the heated airflow 118 back into the dryer 114 and/or dryer zone 106. The recirculated portion of airflow can be combined with the incoming air 110 in the dryer zone 106. In other examples, the printer 100 can include multiple recycling conduits or recirculation ducts.

FIG. 4 illustrates another example printer 400 upon which examples described herein may be implemented. The printer 400 may include a media tray 416 (e.g., a paper tray or trays), a housing 410, and a frame within the housing 410 that includes multiple components. Those multiple components can combine to provide a media path 422 and a dryer zone that includes a dryer 402. The media path 422 may guide a media 414 through the printer 400 in accordance with a print job, where guidance of the media 414 can be accomplished through the use of multiple rollers 420. The rollers 420 can guide the media 414 in the right direction, but may also be used to keep the media 414 from blowing out of position while under the influence of the induced heated airflow 418. The dryer zone may also include the media path 422 and a heated airflow 418 that ejects from the printer 400 at a media eject slot 424.

The printer 400 may also include a print bar assembly 406 and a dryer system. The print bar assembly 406 can deposit ink onto a media 414.

According to some examples, the printer 100 may include a dryer system with a dryer 402 that includes multiple nozzles 404. The dryer 402 can heat incoming air 412 and then eject it through the nozzles 404 in order to evaporate or dry the ink on the media 414. However, as described with previous example printers, it is desirable for the dryer 402 to dry the ink by heating it with heated air, while mitigating or eliminating a heating effect from the dryer with respect to other components throughout the rest of the printer 400.

Accordingly, in some examples, the dryer 402 can be thermally isolated from the rest of the printer 400. Thermal isolation can be accomplished with a structure made up of an air dam, a plastic rib, a baffle, and/or a combination or layers of these. Thus, the printer 400 may be made up of a heated air zone 430 and a cool air zone 432. The heated air zone 430 can be zones within the printer 400 where the heated air is created, retained, and/or ejected from the printer 400. The cool air zone 432 may be outside the heated air zone 430, and can have any temperature cooler than the air in the heated air zone 430. In some examples, the cool air zone 432 is at an ambient air temperature.

In some aspects, the incoming air 412 can come from any area of the printer 400 in which one or more electrical components are located 408. In some examples, incoming air 412 can come from outside the printer 400. The outside air may enter the printer 400, for example, through the media path 422 that guides the media 414 throughout the printer 400 during a print job (e.g., the media 414 can be the path a paper would travel in accordance with a print job). In other examples, the incoming air 412 can originate from inside the printer 400. For example, since the printer 400 may not be completely sealed to the outside, the ambient air from outside the printer may leak into any area of the printer 400.

In some aspects, nozzles 404 that expel the heated air onto the surface of the media 414 can be acutely angled with respect to the surface of the media 414. The angled directionality of the nozzles 404 can serve the functions of drying ink deposited on the media 414 surface, directing heated airflow 418 in a particular direction, and/or both drying and directing the heated airflow 418. A portion of the heated airflow 418 may be ejected from the printer 400 at a media eject slot 424. In some examples, 10-20% of the heated airflow 418 can be ejected.

As a result of the directionality of the heated airflow 418 and ejecting a portion of the heated airflow 426 at the media eject slot 424, the dryer 402 may be a part of a dryer system that induces an airflow of heated air within the printer 400. The ejection of the heated airflow 426 at the media eject slot 424 can be created by a dryer impeller fan 403 which can also create a negative pressure around the dryer 402 with respect to the air pressure outside the dryer 402. This induces outside air to be drawn into the printer 400 toward the dryer 402. The difference in pressure can also induce air already within the printer 400 to be drawn toward the dryer 402 as well. Therefore, the incoming airflow 412 toward the dryer 402 can, accordingly, be made up of both outside and inside air, and as the air travels over printer components 408, those printer components 408 are cooled by the incoming airflow 412 temperature. Since printer components 408 heat up while in use, cooling them by incoming ambient room temperature air may be sufficient to assure the printer components 408 do not overheat.

Printer components 408 may be any electrical source that takes up power. This can include, but is not limited to, a power supplies, chips, electric boards, and or electric motors.

According to one or more examples, the printer 400 may include a recycling system 428 that is positioned to draw a portion of heated air from the heated airflow 418 through the dryer zone. This recirculates the heated air back into the dryer system, which reduces the power consumption needed by the printer 400 to operate. In some examples, the recirculated portion of the heated air is combined with incoming air 412 in the dryer zone. For instance, in the example in which 10-20% of the heated airflow 418 is ejected at the media eject slot 424, the recirculated airflow in the recycling system can be comprised of the remaining 80% of the heated airflow 418. This recirculated airflow may then be re-used by the dryer 402 to dry another media 414 progressing through the media path 422. Additionally and/or alternatively, the recirculated airflow may be re-used by the dryer 402 to dry the same media 414 progressing through the media path 422 (e.g., for a paper going through the media path 422 in accordance with a print job, the recirculated airflow may be re-used on the same page).

It is contemplated for examples described herein to extend to individual elements and concepts described herein, independently of other concepts, ideas or system, as well as for examples to include combinations of elements recited anywhere in this application. Although examples are described in detail herein with reference to the accompanying drawings, it is to be understood that the concepts are not limited to those precise examples. Accordingly, it is intended that the scope of the concepts be defined by the following claims and their equivalents. Furthermore, it is contemplated that a particular feature described either individually or as part of an example can be combined with other individually described features, or parts of other examples, even if the other features and examples make no mentioned of the particular feature. Thus, the absence of describing combinations should not preclude having rights to such combinations.

What is claimed is:

1. A printer comprising:

a print bar assembly to deposit printing material in accordance with a print job; and a dryer system to intake and heat air from an internal region of the printer in which one or more electrical components of the printer are located, the dryer system to direct the heated air through multiple outlets that are acutely angled with respect to media of deposited printing material to dry the printing material while cooling the internal region of the printer.

2. The printer of claim 1, further comprising:

a housing; and a frame within the housing, the frame including multiple components that combine to provide a dryer zone and a media path for the media.

3. The printer of claim 2, wherein the frame includes one or more recycling conduits that are positioned to draw heated air from a surrounding region through the dryer zone.

4. The printer of claim 2, wherein the dryer system is to create an airflow within the printer between the dryer zone and an outlet for the heated air from the dryer system.

5. The printer of claim 1, wherein the dryer system is to direct the outlet for the heated air to coincide with a location of a media eject slot of the printer.

6. The printer of claim 1, wherein one or more recycling conduits are to recirculate a portion of the heated air back into a dryer zone, wherein the dryer zone is to combine the recirculated portion of the heated air with incoming air.

7. The printer of claim 1, wherein the dryer system is thermally isolated within the printer.

8. The printer of claim 1, wherein the dryer system includes a plurality of nozzles, each nozzle of the plurality is to output a corresponding portion of the heated air in a direction that is acutely angled with respect to the media traveling through the printer along a media path.

9. The printer of claim 1, wherein at least a portion of the multiple outlets have an angle greater than 0 degrees with respect to a normal of a media surface.

10. The printer of claim 1, wherein at least a portion of the multiple outlets have an angle between 10 and 40 degrees with respect to a normal of a media surface.

11. The printer of claim 1, further comprising a frame to physically and thermally isolate the internal region.

12. The printer of claim 11, wherein the frame includes a structure selected from the group consisting of: an air dam, a plastic ribs, and a baffle.

13. The printer of claim 1, further comprising an impeller fan, the impeller fan to bring incoming air to a dryer zone, and to mix and pressurize the incoming air.

14. A method of operating a printer, the method comprising:

depositing ink on a media in accordance with a print job; and drying the ink on the media by intaking air from an internal region in which one or more electrical components of the printer are located, heating the air, and directing the heated air through multiple outlets that are acutely angled with respect to a path of travel of the media, to dry the ink while cooling the internal region of the printer.

15. A dryer system comprising:

an intake system within a frame of a printer to intake air from an internal region of the printer in which one or more electrical components of the printer are located;

a heating element to heat the intaked air; and multiple outlets that are acutely angled with respect to media, the individual outlets to directionally output the heated air in a direction that at least partially coincides with a path of travel of the media to dry ink on the media while cooling the internal region of the printer.

* * * * *